US005593355A

United States Patent [19]

Beaver

[11] Patent Number: 5,593,355

[45] Date of Patent: Jan. 14, 1997

[54] GOLF PRACTICE APPARATUS

[75] Inventor: Michael L. Beaver, Grand Haven, Mich.

[73] Assignee: Fore-Mat Products, Inc., Grand Haven, Mich.

[21] Appl. No.: 412,464

[22] Filed: Mar. 29, 1995

[51] Int. Cl.[6] ..... A63B 69/36

[52] U.S. Cl. ..... 473/278; 473/262

[58] Field of Search ..... 273/183.1, 186.1, 273/186.4, 195 R, 195 A, 195 B, 176 H, 176 J, 187.1, 33, 202–212; 267/36.1, 37.1, 39, 40, 41, 42, 43, 46; 473/262, 278

[56] References Cited

U.S. PATENT DOCUMENTS

| | | | |
|---|---|---|---|
| 206,050 | 7/1878 | Springer | 267/39 |
| 1,594,359 | 8/1926 | Estabrook . | |
| 1,933,239 | 10/1933 | Boe | 273/205 |
| 2,509,166 | 5/1950 | Phillips et al. | 273/204 |
| 3,143,350 | 8/1964 | Lester . | |
| 3,345,073 | 10/1967 | Hoffman . | |
| 3,423,096 | 1/1969 | Tone . | |
| 3,712,628 | 1/1973 | Boss, Jr. . | |
| 3,869,128 | 3/1975 | Ohashi | 273/195 A |
| 4,106,772 | 8/1978 | Krawagna | 273/195 R |
| 4,130,283 | 12/1978 | Lindquist . | |
| 4,311,312 | 1/1982 | O'Brien . | |
| 4,387,896 | 6/1983 | O'Brien . | |
| 4,451,043 | 5/1984 | Ogawa et al. . | |
| 4,875,685 | 10/1989 | Ballinger et al. . | |
| 4,913,442 | 4/1990 | Walker . | |
| 4,928,966 | 5/1990 | Miller . | |
| 4,932,663 | 6/1990 | Makar . | |
| 4,955,611 | 9/1990 | Moller . | |
| 5,028,052 | 7/1991 | Miller . | |
| 5,232,419 | 8/1993 | Kozak . | |
| 5,273,285 | 12/1993 | Long . | |
| 5,340,109 | 8/1994 | Miller . | |
| 5,356,147 | 10/1994 | MacDonald . | |
| 5,387,166 | 2/1995 | Gvoich . | |

OTHER PUBLICATIONS

Catalog Sheet, "Divot Action™ mat," Playfield Industries, Inc., Dallas, Texas, on sale more than one year prior to the date of this application.

*Primary Examiner*—Steven B. Wong

*Attorney, Agent, or Firm*—Price, Heneveld, Cooper, DeWitt & Litton

[57] ABSTRACT

A golf practice apparatus having a resilient leaf spring which serves as the striking surface, retained within a housing. Upon being impacted by a golf club, the center portion of the spring is depressed downwardly, and the ends of the spring, being free and unobstructed, translate outwardly to permit the club head to pass through the ball and over the striking surface. The practice apparatus accurately simulates the feel of a golf swing on natural turf, eliminates shock to the golfer's arms from a mishit, and provides feedback to the golfer as to how well each swing is executed.

25 Claims, 3 Drawing Sheets

GOLF PRACTICE APPARATUS

BACKGROUND OF THE INVENTION

The present invention relates to a golf apparatus, and more particularly to a device which simulates the response of natural turf to the impact of a golf club head during a golf swing.

One of the keys to becoming a successful golfer is to consistently and frequently practice the many skills necessary in the game. These include, among others, the drive, the wedge shot, and the chip shot. Each of these facets of golf has its own technique for practicing and improving upon one's skill level.

One such technique involves the repetitive hitting of a golf ball, whether in the home back yard or at a commercial driving range, to practice the basic golf swing using real golf balls and clubs in an accepted manner. One problem with this practice is that, if the ball is hit directly off the ground or even off of a tee, the turf surrounding the practice area may quickly become worn and unsightly. This is especially true in the case of iron shots because a properly executed iron shot will often cause the removal of a small patch of turf known as a divot. To remedy this, the golfer must either retrieve each divot and tamp it back in its original place, which is very time-consuming, or the golfer can continue to hit off of the bare dirt spots on the ground. However, a hit off of barren turf would not provide a natural response to the impact of the club head, and therefore one would not obtain the proper feel during the swing nor would the golf ball travel in a trajectory which is properly indicative of the quality of the swing.

Historically, a golf tee mat has been provided to combat this problem. Such mats are typically made out of a rubber-containing material, or with artificial turf. These mats provide a consistent surface from which to hit the ball, but the surface does not simulate the response of natural turf to an executed golf swing. A correctly executed iron shot, for example, results in the arc described by the club head having its lowest point forward of, and below the rest position of the ball. Normally, this would result in a divot being taken out of the turf by the club head after it has struck the ball. During practice, it would be preferable to hit down into a point immediately in front of the ball, as one would do on natural turf, with the resulting divot occurring during the follow-through of the swing. Because of the unyielding nature of the known practice mats, a golfer is prevented from taking such a natural swing. An attempt to execute this swing can result in the club head catching in the mat and either stopping abruptly, bouncing up, or roaring the mat. The golfer, in attempting to avoid hitting the mat, must make an unnatural adjustment to his swing. This adjustment usually consists of an attempt to sweep the club head across the top of the mat to hit the ball cleanly, yet not hit the mat. This required adjustment is counter-productive to a practice session wherein the golfer would prefer to work on problems associated with his golf swing, rather than problems associated with driving range mats.

Various solutions to these problems have been previously proposed. For example, in U.S. Pat. No. 3,423,096 to Tone, the basic structure of the device is a spring-mounted rigid platform containing a grass-simulating upper surface. When the device is struck by a golf club head during a correctly executed swing, it is capable of deflecting only downward. The ball support surface cannot move horizontally. When a golf club head is impacted against the Tone mat with a velocity that is more horizontal than vertical, the device will only partially correct those problems associated with the traditional golf tee mats.

Another proposed solution is the device described in U.S. Pat. No. 3,712,628 to Boss, Jr., which includes a rigid housing containing horizontally mounted rollers which support an endless belt having grass simulating bristles on its outer surface. A padded platform beneath the upper portion of the belt is mounted so as to pivot about one end and is held against the inner surface of the belt by an elastic supporting member at the other end. The rollers are designed to minimize their resistance to acceleration resulting from the tangential forces imparted by the belt. The uppermost surface of the padded platform is made smooth to minimize friction between the belt and pad allowing translation of the belt across the platform following impact of the golf club head. As the golf club head strikes the belt, the vertical energy component is transferred from the belt to the platform and then to the elastic supporting member which yields, permitting the platform to pivot downwardly. The belt simultaneously translates forwardly as it moves about the rollers due to the horizontal energy component transmitted to it by the club head. The combined downward and forward deflections of the belt momentarily forms a pocket in the belt simulating that left by a removed divot.

One disadvantage associated with such prior art devices is that they are too forgiving of certain types of bad golf swings, particularly one known as a "fat shot," and therefore do not provide feedback to the golfer that his swing was poorly executed. A "fat shot" is one in which the club head hits downwardly toward the ball at approximately the correct angle but the club head catches the turf before hitting the ball. Consequently, there is a buildup of turf between the ball and the club head which makes the ball travel a lesser distance than it would if the swing were properly executed. The fatter the shot the less distance the ball travels. With a device such as that disclosed in the Boss, Jr. patent, a club head which, for example, impacts the belt an inch behind the ball would cause the belt and platform to pivot downwardly immediately upon contact of the golf club head with the belt and the belt would immediately translate forwardly offering little resistance to the club head, thereby allowing the club head to move easily forward into contact with the ball without simulating the buildup of turf that would occur if such a swing were executed on a natural surface.

Another type of belt and roller type golf device is shown in U.S. Pat. No. 4,875,685 to Ballinger et al.

Thus, a need exists for a golf practice apparatus which more accurately simulates the feel of natural turf, and which provides feedback to the golfer to indicate whether or not the ball has been struck with an accurate swing.

SUMMARY OF THE INVENTION

In the present invention, a golf practice apparatus is provided which comprises a flexible, resilient leaf spring. The leaf spring itself serves as the striking surface, and is displaced downwardly upon the impact of a golf club. The ends of the leaf spring are unobstructed and free to move, allowing for movement of the leaf spring in the horizontal direction.

In further aspects of the invention, a housing is provided to capture and retain the spring, thereby preventing excessive movement of the spring. A layer of artificial turf may be provided on the leaf spring. Optionally, protective covering can be placed over the entire apparatus.

The golf apparatus of the present invention accurately simulates the feel of a golf swing on natural turf, and provides the golfer with feedback as to how well each swing is executed.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
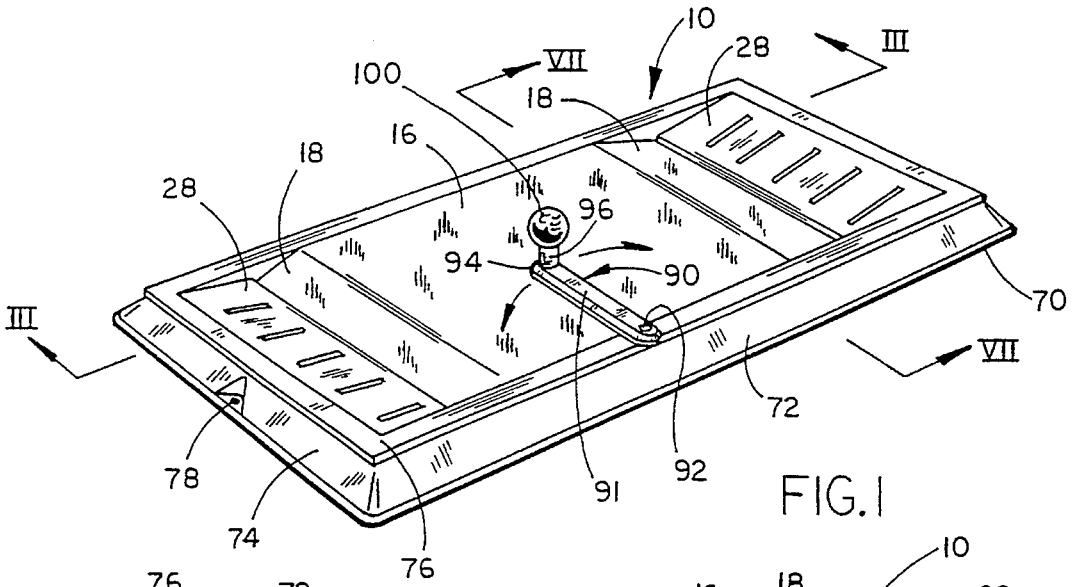
FIG. 1 is a perspective view of a golf practice apparatus in accordance with the present invention, with a golf ball positioned on a spin tee.

For purposes of description herein, the terms "upper," "lower," "right," "left," "front," "vertical," "horizontal," and derivatives thereof shall relate to the invention as oriented in FIG. 1. However, it is to be understood that the invention may assume various alternative orientations and step sequences, except where expressly specified to the contrary. It is al, so to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In the preferred embodiment, a golf practice apparatus is provided, shown generally in FIGS. 1–14B and designated by the numeral 10. The illustrated practice apparatus 10 includes a composite leaf spring 12 retained within a housing 14. Practice apparatus 10, when struck by a golf club head, accurately simulates the response of natural turf, reduces or eliminates the shock to the golfer from missed hits, and provides feedback to the golfer as to whether the swing resulted in a clean or "sweet" shot, or a poor or "fat" shot. The apparatus may be used to practice all types of swings, with all types of clubs.

This improved, strikingly authentic natural-turf feel is due in large part to leaf spring 12. Leaf spring 12 may be made of any suitable, resilient type of material. For example, leaf spring 12 could be a conventional steel spring or could be constructed of a polyurethane, polyethylene, polystyrene, polypropylene material, or the like. In the preferred embodiment, leaf spring 12 is a fiberglass reinforced composite spring. Leaf spring 12 is self-supporting, i.e., leaf spring 12 itself serves as the striking or hitting surface, rather than supporting a separate hitting platform or endless belt. It has been found that using leaf spring 12 in this manner as a golf practice apparatus has yielded remarkably accurate ball response. Leaf spring 12 absorbs the shock of a bad hit, and telegraphs this mishit up the length of the shaft of a golf club to the hands of the golfer.

Leaf spring 12 may be constructed to give different feels, from very loose to very tight, depending upon one's preference. Leaf spring 12 may be provided in different widths and thicknesses. It is preferable that leaf spring 12 be a one-piece composite spring, although it is possible that a plurality of smaller, narrow strips of spring could be placed in a row next to each other and still serve a similar purpose.

The preferred leaf spring 12, a fiberglass reinforced composite spring, does not rust, an element which tends to shorten the life of steel springs. Due to this high resistance to corrosion, the preferred leaf spring 12 may be used in environments which contain aggressive liquids and vapors. Whereas known driving mats or devices may be affected by weather, water, or extreme temperatures, the leaf springs of the preferred embodiments can withstand high and low temperatures. These preferred springs also have superior dielectric properties. The preferred spring also has a constant coefficient of resistance, and a great "memory" or repetitive resilience, i.e., the spring will bounce back or return to its original at-rest position following a blow from a golf club.

Figure 5:
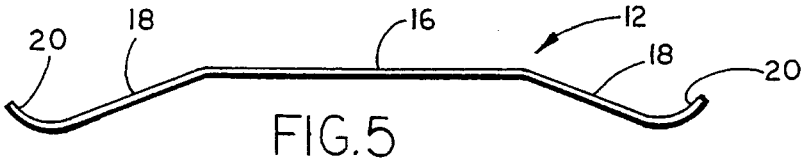
FIG. 5 is a side elevational view of the leaf spring in accordance with the present invention.

The overall shape of leaf spring 12 does play a factor in providing the increased natural turf feel. In the preferred embodiment, leaf spring 12 has a flat, inverted U-shape in side elevation and comprises a middle, striking surface or platform, that is substantially flat and horizontal, as best seen in FIG. 5. Extending downwardly from striking surface 16 are two sloping surfaces 18, oppositely spaced from each other. Each sloping surface has an upturned end portion 20, adapted to be retained within housing 14.

Figure 5A:
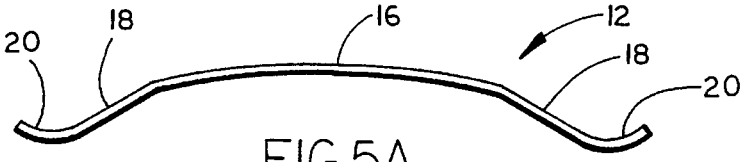
FIG. 5A is a side elevational view of an alternate form of leaf spring in accordance with the present invention.
Figure 7:
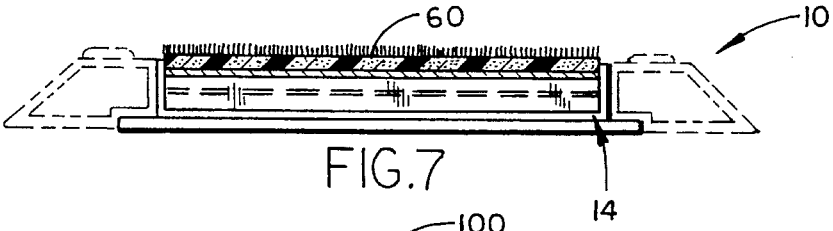
FIG. 7 is a vertical cross-sectional view of the golf practice apparatus taken along the lines VII—VII of FIG. 1, including a layer of artificial turf.
Figure 8:
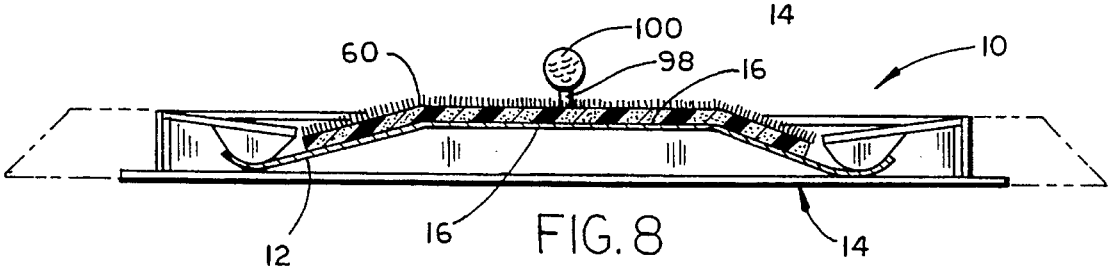
FIG. 8 is a vertical cross-sectional view of the golf practice apparatus taken along the lines VIII—VIII of FIG. 2, prior to being struck by a golf club head.
Figure 10:
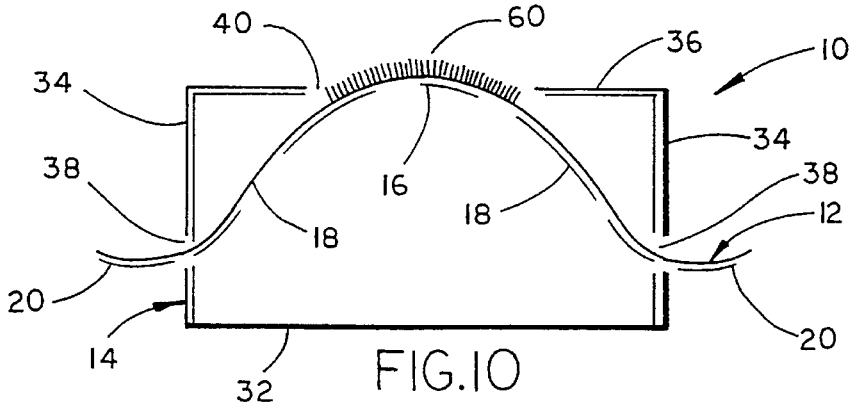
FIG. 10 is a partially schematic vertical cross-sectional view of a first alternate form of housing and leaf spring.
Figure 11:
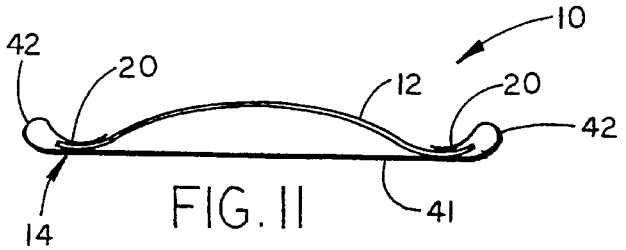
FIG. 11 is a partially schematic side elevational view of a second alternate form of housing and leaf spring.
Figure 12:
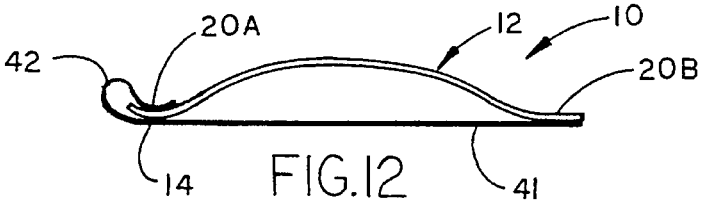
FIG. 12 is a partially schematic side elevational view of a third alternate form of housing and leaf spring.

Although this is the preferred leaf spring configuration, many others are possible. For example, the leaf spring 12 shown in FIG. 5A, rather than having a substantially flat striking surface 16, has a striking surface 16 that is slightly arc shaped. Another example, leaf spring 12 shown in FIG. 10, is substantially an inverted U-shaped design, there being no exact point where middle striking surface 16 ends and sloping surfaces 18 begin. Rather, leaf spring 12 in this design is a continuous arc or curve, while still having end portions 20, which may or may not be upturned. Another shape of leaf spring 12 is shown in FIGS. 11 and 12. This shape is flatter than that shown in FIG. 10, yet is still rounded or curvy. Finally, in FIG. 13, leaf spring 12 is again an inverted U-shape, but has no upturned end portions 20. Any of these spring configurations would be sufficient to provide the desired natural turf feel required for the golf practice apparatus of the present invention.

Leaf spring 12, in addition to having a curved or arc-shaped striking surface 16 in the longitudinal direction, may also be curved or arc-shaped laterally, i.e., across the width of leaf spring 12. In this configuration, striking surface 16 of leaf spring 12 would be substantially dome-shaped.

Figure 4:
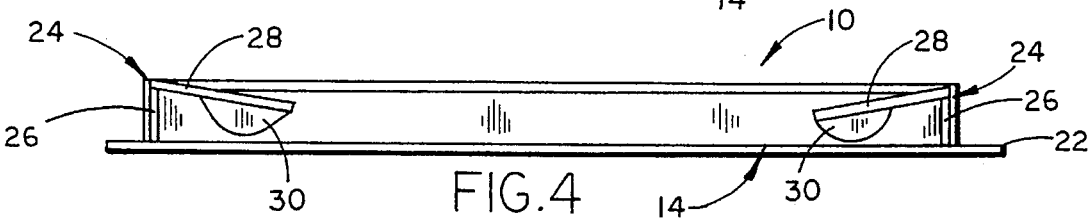
FIG. 4 is a vertical cross-sectional view of the housing of FIG. 3, without the leaf spring.

Leaf spring 12 is typically retained within housing 14. In the preferred embodiment, housing 14 comprises a base 22 and guides 24, as best seen in FIG. 4. Base 22 is a substantially flat, horizontal member, and may be constructed of any suitable material. Guide 24 includes an upwardly projecting portion 26, substantially perpendicular to base 22, and a downwardly projecting flange 28, which angles diagonally down towards base 22. Attached to flange 28 is a cup-shaped retainer 30. One guide 24 is placed at each end of base 22. The cup-shaped retainer 30 may extend continuously across the width of the apparatus 10, or may be a series of individual cup-shaped retainers 30 spaced apart from one another.

Figure 3:
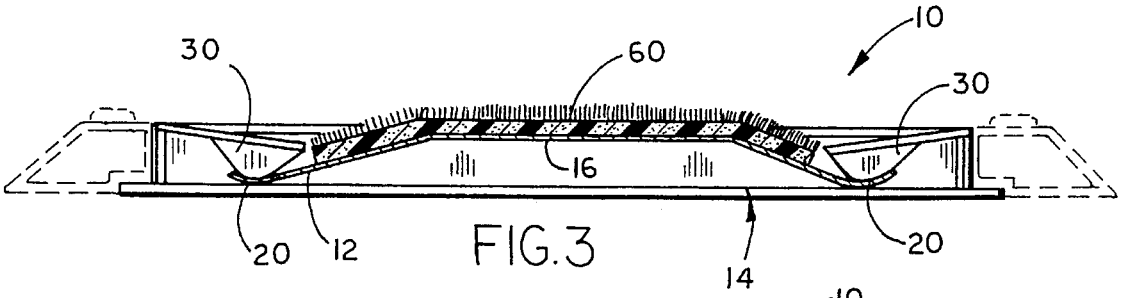
FIG. 3 is a vertical cross-sectional view of the golf practice apparatus taken along lines III—III in FIG. 1, including a layer of artificial turf.
Figure 9:
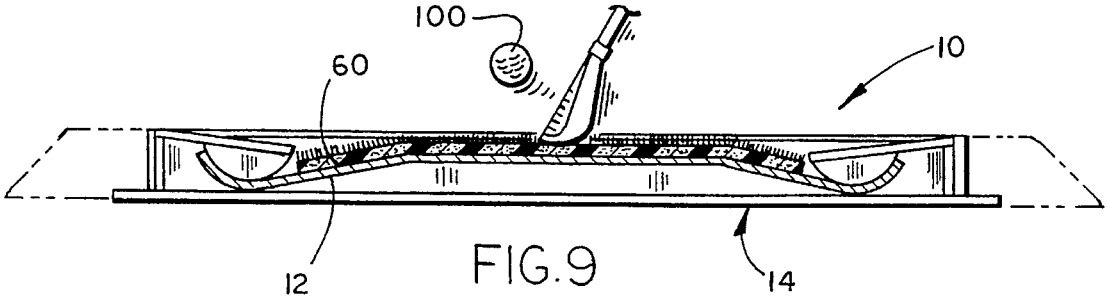
FIG. 9 is a vertical cross-sectional view of the golf practice apparatus of FIG. 8, showing the effect of the impact of a golf club head on the leaf spring during a swing.

As best seen in FIG. 3, leaf spring 12 is placed within housing 14 so that each cup-shaped retainer 30 fits over and captures upturned end portions 20 of leaf spring 12 between cup-shaped retainer 30 and base 14, thereby retaining leaf spring 12 without the need for any permanent fasteners. The free or "floating" end portions 20 are important to the operation of golf practice apparatus 10. As shown in FIG. 9, when leaf spring 12 is struck by the head of a golf club, leaf spring 12 is displaced downwardly at the point of impact. The free or floating end portions 20 are simultaneously displaced outward, traveling along cup-shaped retainer 30. This unobstructed glide of at least one of the ends 20 of leaf spring 12 is an important element of the preferred embodiment. This allows the leaf spring 12 to move forward and/or backward at impact. Once the swing is complete, leaf spring 12, being resilient, will return to its original position. This housing and leaf spring configuration also provides a golf practice apparatus that is relatively quiet in operation. Known golf devices are often noisy and loud, due to a multitude of parts, or a loose fit between parts. In contrast, golf practice apparatus 10 has few parts, and a relatively snug fit between these parts, which move or glide with respect to each other in a quiet manner. This quiet operation reduces the distraction normally involved when more than one golfer utilizes a practice device in close proximity to another golfer.

The complex motion of leaf spring 12 in response to impact by the head of a golf club permits the club head to pass through the ball and over the striking surface, accurately simulating the response of a golf club head hitting a natural turf surface. The golf practice apparatus 10 of the preferred embodiment also substantially reduces shock to the golfer's body, i.e., arms, wrists, shoulders, neck, back, etc., that can result from striking traditional golf mats. The resilient nature of leaf spring 12 absorbs the impact of even a poorly executed swing, permitting the club head to pass over the striking surface, rather than causing the club head to stop abruptly, thereby shocking the golfer's arms, etc. This same mechanism also provides feedback to the golfer as to how well each swing has been executed. In a well-executed or "sweet" shot, i.e., when the golfer strikes the ball prior to striking leaf spring 12, leaf spring 12 will be displaced downwardly first by the ball and then, only slightly, by the club head, providing little resistance to the movement of the golf club head through the ball. This slight resistance will translate up the length of the shaft of the golf club to the golfer's hands and arms, letting the golfer know that a "sweet" shot has been executed. Likewise, if the golfer executes a poor or "fat" shot, i.e., one in which the golf club head strikes leaf spring 12 prior to the ball, leaf spring 12 will be displaced downwardly a greater distance, and there will be more resistance to the passage of the golf club head through the ball, although not enough to adversely shock the golfer's arms, wrists, and hands. The golfer will feel this added displacement of leaf spring 12 and greater resistance of the golf club head passing over striking surface 16, letting the golfer know that a "fat" shot has been executed. The golfer can then alter his or her swing through by practicing on golf practice apparatus 10, until the number of "fat" shots is minimized. This should translate into longer and more accurate shots once the golfer actually hits on a natural turf surface, such as an outdoor golf course.

It is to be understood that this is the preferred leaf spring and housing arrangement. Other shapes of leaf spring 12, as previously discussed, would perform the same function. It is also possible to utilize other types of housings, or none at all.

One alternate type of housing is that shown in FIG. 10. In this embodiment, housing 14 consists of a bottom 32, two sides 34, and a top 36, forming a box-like configuration. Each side 34 is provided with a narrow slit or hole 38. Top 36 is provided with an opening 40. Leaf spring 12 is positioned within housing 14 in this embodiment so that each end portion 20 extends through slits 38, and the peak of leaf spring 12—striking surface 16—extends slightly through opening 40 in top 36. The mechanism of operation is the same, i.e., when struck by a golf club, leaf spring 12 displaces downwardly, pushing end portions 20 further through slits 38, and returns to its original position following impact. End portions 20 may or may not be upturned, but should be of a length sufficient to prevent end portions 20 from becoming entrapped within housing 14.

Another possible leaf spring and housing structure is shown in FIG. 11. In this embodiment, housing 14 is a continuous, one-piece member having a flat base portion 41 with ends that curve back in and point towards each other, forming clip retainers 42. Each clip retainer 42 is adapted and designed so as to fit snugly over end portions 20 of leaf spring 12, capturing end portions 20 in much the same fashion as cup-shaped retainers 30 in the preferred embodiment. Clip retainers 42 should be long enough to prevent leaf spring 12 from popping out of or becoming removed from housing 14. However, there should also be a sufficient gap between the tip of each end portion 20 and the curved portion of each clip retainer 42, to allow for horizontal displacement of leaf spring 12 when struck by a golf club.

One variation of this embodiment is that shown in FIG. 12. In this embodiment, one end 20B of leaf spring 12 is fixed to base portion 41, while the other end portion 20A is retained within clip retainer 42 as described previously. As in each of the embodiments discussed, it is only necessary that at least one of end portions 20 (e.g., 20A) of leaf spring 12 be free or "floating." This allows for absorption of the forces of a golf club blow. However, it is preferable that both end portions 20 be free, to allow for maximum absorption of these forces, thereby providing for extra "give" of leaf spring 12 and therefore, a better, more accurate natural turf feel.

Figure 13:
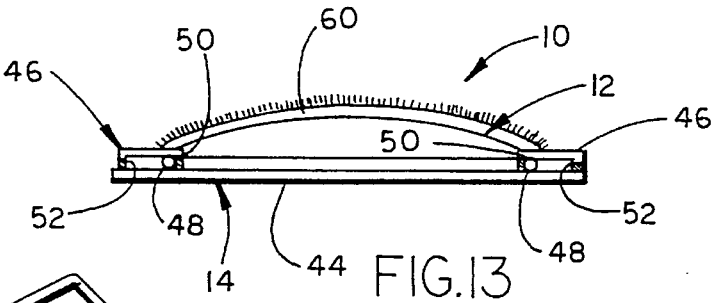
FIG. 13 is a partially schematic side elevational view of a fourth alternate form of housing and leaf spring.

Another alternate embodiment is that shown in FIG. 13. In this configuration, housing 14 consists of a base 44 having brackets 46 positioned at each end. Each bracket is a square, inverted U-shaped member. Leaf spring 12 is arc-shaped, having no upturned ends. Attached to each end portion 20 is a pin 48. Pin 48 fits in and is retained by bracket 46. In its resting position, each pin of leaf spring 12 is positioned against the inside of bracket 46, against inner edge 50. When leaf spring 12 is struck and displaced downwardly, pin 48 is displaced, sliding along base 44 until contacting outer edge 52 of bracket 46. After the blow, leaf spring 12 cycles back into place, pins 48 traveling along base 44 back to inner edge 50.

Each of these different housing 14 configurations are suitable in the present invention. However, it has been found that even the leaf spring itself, with no housing, performs in an adequate fashion the turf-simulating function of the embodiments which include a housing. Leaf spring 12, in any of the described shapes, although preferably having upturned end portions 20, may simply be placed by itself on a surface, such as concrete if indoors or grass if outdoors, and used in the same manner as the spring and housing embodiments.

Each of the embodiments which include a housing 14 may be used simply by placing it on a surface, preferably a flat surface. For example, if a golfer were going to practice his swing indoors by hitting into a net, golf practice apparatus 10 would merely be placed on the floor and hitting would be commenced. If outdoor practice were desired, the apparatus would be placed on the ground. The apparatus 10 may also be placed in a conventional practice pit or trap, found preconstructed at many golf courses and driving ranges. Finally, golf practice apparatus may be set in a recess or opening which is dug into the ground to a depth which would place the striking surface at ground level, or dirt or sod may be placed up against the edges of apparatus 10 to provide a more natural look and feel, and to make the top or striking surface 16 of leaf spring 12 more coplanar with the surrounding practice area.

It is not necessary to cover leaf spring 12 with any material in order to effectively use practice apparatus 10. Leaf spring 12 may be provided with a standard tee 98, shown in FIG. 8, upon which the golf ball would rest, or leaf spring 12 may have a small dimple therein in which the ball would nestle. Preferably, however, leaf spring 12 is provided with a layer of artificial turf 60, as shown in FIGS. 3, 7–10, and 13. Turf 60 may be of any conventional synthetic turf material, such as indoor/outdoor carpeting or knitted nylon, well-known in the art. Turf 60 can have any height of grass members and be of any desired thickness or density. Turf 60 is applied to leaf spring 12 using conventional means, such as common spray adhesives or two-sided carpet tape. Preferably, turf 60 is applied using strips of Velcro™ material. This allows turf 60 to be easily and quickly removed when replacement is necessary, for example, when the turf becomes worn, or if a different height of grass or thickness of turf is desired.

Golf practice apparatus 10 may also be provided with a spin tee 90, as shown in FIG. 1. This type of tee consists of a flat, elongated member 91, preferably constructed of a pliable material, which is pivotally or removably attached at one end 92 to rim 76 of covering 70 and which has a tee 96 at the opposite end 94. The pivotal attachment allows spin tee 90 to be selectively placed or removed from the striking surface, depending upon the golfer's particular desire to utilize a tee. When spin tee 90 is used to support a golf ball, spin tee 90 provides the added feature that when the ball 100 and tee 96 are struck by a golf club during a practice swing, the club head will cause the spin tee 90 to rotate out away from the striking surface, thereby providing a clearer path for the follow-through of the swing, as well as increasing the longevity of the tee 96, which would not be subject to the same wear and tear that a fixed tee would endure.

Figure 2:
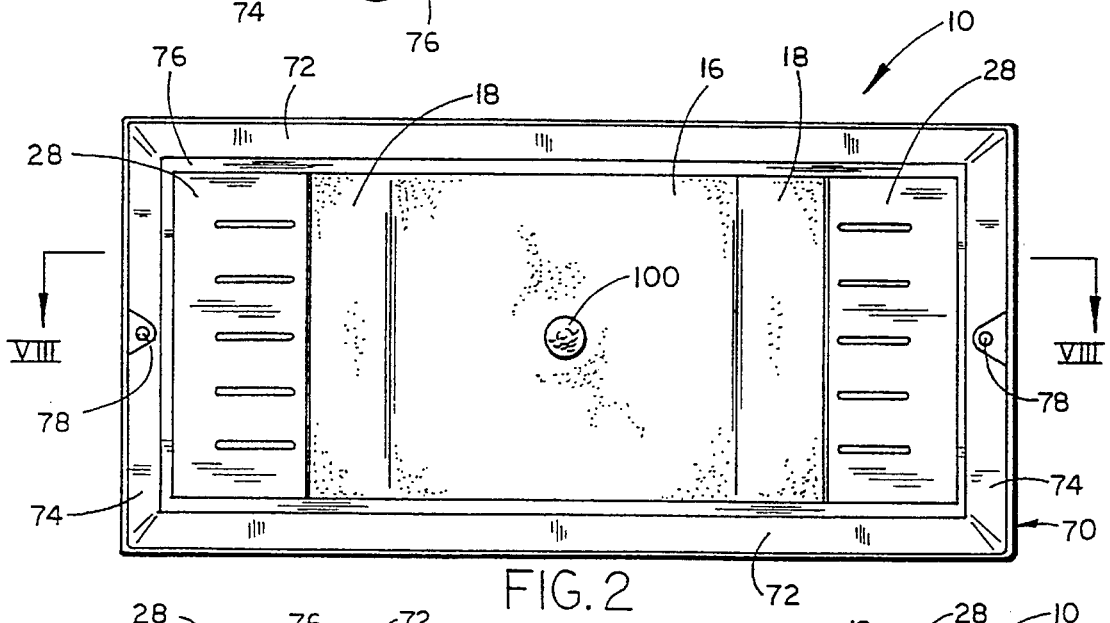
FIG. 2 is a top plan view of the golf practice apparatus, with a golf ball positioned on a standard tee.
Figure 6:
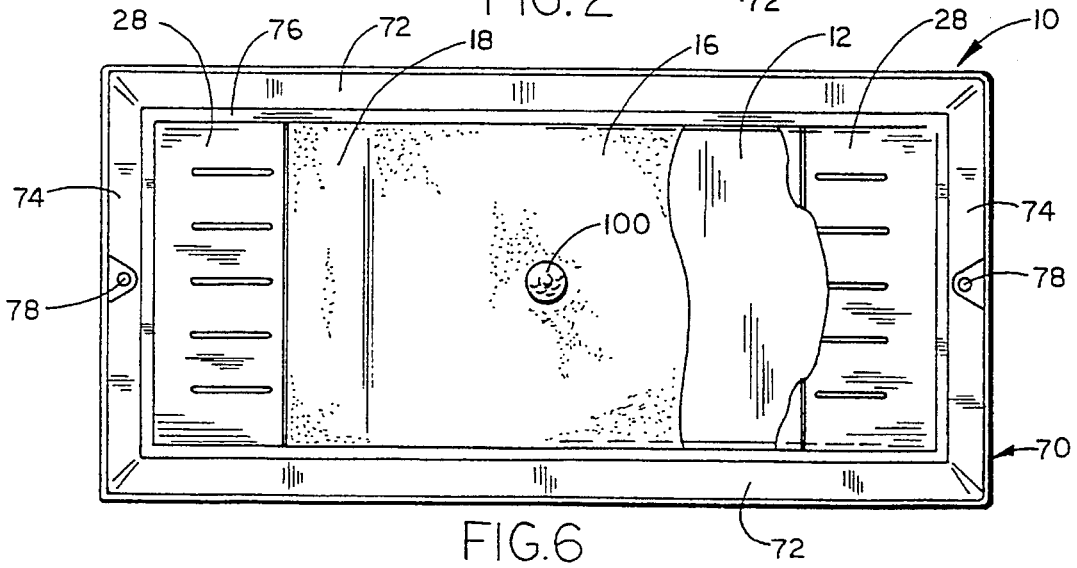
FIG. 6 is a top plan view of the golf practice apparatus, with portions thereof broken away to show a leaf spring underneath a layer of artificial turf.

Golf practice apparatus 10 may also include a protective or decorative covering 70, as shown in FIGS. 1, 2, and 6. Covering 70 fits over leaf spring 12 and housing 14 and is attached to housing 14. Covering 70 includes sides 72 and ends 74, and a lip or rim 76 running along the top edge of sides 72 and ends 74, which defines an opening. When fitted over leaf spring 12 and housing 14, rim 76 of covering 70 at ends 74 contacts the top of flange 28, as seen in FIG. 1. Leaf spring 12 is positioned within the opening defined by rim 76, so that striking surface 16 is substantially coplanar with rim 76. Downwardly sloping surfaces 18 of leaf spring 12 are also visible through the opening defined by rim 76. Upturned end portions 20 of leaf spring 12 are not visible, however, being hidden from view beneath flange 28 and cup retainer 30. Covering 70 not only provides an attractive means of displaying practice apparatus 10, it also provides an added feature of maintaining the visual continuity between the striking surface 16 of leaf spring 12 and the surrounding environment. Covering 70 and housing 14 may be separate members, or they may be molded as one integral piece. Covering 70 may optionally be provided with holes 78 for anchoring the entire apparatus to the ground.

Figure 14A:
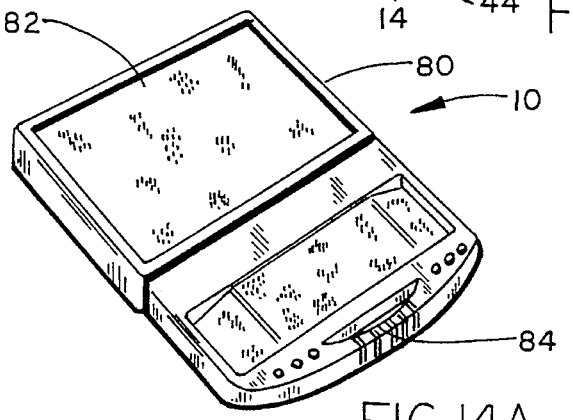
FIG. 14A is a perspective view of the golf practice apparatus of the present invention, shown in a carry-case format, extended and ready for use.
Figure 14B:
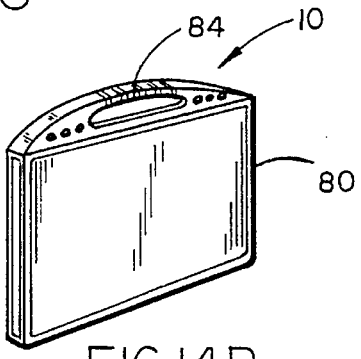
FIG. 14B is a perspective view of the golf practice apparatus of FIG. 14A, in the closed, ready-to-carry mode.

As another variation on the invention, golf practice apparatus 10 could be constructed or used in combination with a carry case design 80, as shown in FIGS. 14A and 14B. In this embodiment, carry case 80 includes a platform 82, in which golf apparatus 10 is slidably mounted. Golf apparatus 10 has a handle 84 attached to it, to allow apparatus 10 to be pulled out of carry case 80, or, when apparatus 10 is pushed in and stored within case 80, handle 84 is used to carry the entire apparatus. Platform 82, like leaf spring 12, may optionally be provided with a layer of artificial turf or the like. A golfer would stand on platform 82 and then hit the ball off of practice apparatus 10.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

The embodiments of the invention in which an exclusive property or privilege is claimed are defined as follows:

1. A golf practice apparatus, comprising:

a housing having at least one guide disposed therein;

a single leaf spring retained within said housing, and having a centrally disposed striking surface shaped to support a ball thereon, and opposite ends;

at least one of said ends of said single leaf spring being slidably captured in said housing by said guide and preventing inadvertent separation of said spring from said housing, yet permitting at least one of said spring ends to shift longitudinally, such that when a golf club head strikes a ball positioned on said striking surface, said single leaf spring deflects resiliently downwardly, and at least one of said ends is displaced longitudinally to permit the club head to pass over said striking surface and through the ball, and thereby simulate the response of a golf club head hitting a natural turf surface.

2. The golf club practice apparatus of claim 1, wherein said leaf spring is a one-piece composite leaf spring.

3. The golf practice apparatus of claim 2, wherein said leaf spring has an inverted U-shape in side elevation.

4. The golf practice apparatus of claim 3, wherein said striking surface of said leaf spring includes a layer of synthetic turf.

5. The golf practice apparatus of claim 4, further comprising a tee for supporting a golf ball.

6. The golf practice apparatus of claim 5, wherein said tee is pivotally mounted on said housing.

7. The golf practice apparatus of claim 6, wherein:

said guide comprises a cup-shaped retainer, wherein said one end of said single leaf spring is disposed.

8. The golf practice apparatus of claim 7, wherein:

one guide is positioned at each end of said housing, and each end of said single leaf spring is captured and retained therein.

9. The golf practice apparatus of claim 8, wherein:

said ends of said single leaf spring have upturned portions mating with the cup-shaped retainer of each said guide.

10. The golf practice apparatus of claim 9, wherein:

said centrally disposed striking surface of said single leaf spring has a substantially flat shape to facilitate supporting a ball thereon.

11. The golf practice apparatus of claim 10, wherein:

said single leaf spring has a pair of downwardly sloping surfaces disposed on opposite sides of said striking surface.

12. The golf practice apparatus of claim 11, wherein:

said upturned portions of said spring ends are arcuately shaped.

13. The golf practice apparatus of claim 12, wherein:

said cup-shaped retainers are supported on said housing by resilient flanges.

14. The golf practice apparatus of claim 13, wherein:

said housing is box-shaped, and includes a base on which said single leaf spring is at least in part supported.

15. The golf practice apparatus of claim 1, wherein:

said single leaf spring has an inverted, substantially U-shaped side elevational configuration.

16. The golf practice apparatus of claim 15, wherein:

said striking surface is substantially flat.

17. The golf practice apparatus of claim 15, wherein:

said ends of said single leaf spring have upturned portions.

18. The golf practice apparatus of claim 1, wherein:

said single leaf spring includes a layer of synthetic turf covering at least said striking surface.

19. The golf practice apparatus of claim 18, wherein:

said layer of synthetic turf is detachably mounted on said single leaf spring to facilitate replacement of the same.

20. The golf practice apparatus of claim 1, wherein:

said housing includes two guides positioned adjacent forward and rearward sides thereof; and each of said ends of said single leaf spring is slidably captured in an associated one of said guides.

21. The golf practice apparatus of claim 20, wherein:

each of said guides includes a downwardly projecting, cup-shaped retainer slidably engaging an associated end of said single leaf spring.

22. The golf practice apparatus of claim 21, wherein: said cup-shaped retainers are supported on resilient flanges.

23. The golf practice apparatus of claim 1, wherein:

said housing is box-shaped, and includes a base on which said single leaf spring is at least in part supported.

24. The golf practice apparatus of claim 1, wherein:

said single leaf spring is one piece, and is constructed from a fiberglass reinforced, synthetic resin material.

25. The golf practice apparatus of claim 23, wherein:

said single leaf spring has glass fibers oriented substantially longitudinally in said synthetic resin material.

* * * * *